United States Patent [19]

Colognori

[11] 4,358,876

[45] Nov. 16, 1982

[54] NECKLACE RETAINING CLASP

[75] Inventor: Aldo Colognori, 69 Lawton Ave., Cliffside Park, N.J. 07010

[73] Assignees: Aldo Colognori; Sebastian Zuppichini; Thomas McBride, all of Hillsdale, N.J.

[21] Appl. No.: 211,733

[22] Filed: Dec. 1, 1980

[51] Int. Cl.[3] ..... A44B 17/00

[52] U.S. Cl. ..... 24/211 R; 24/214; 24/221 K; 339/252 R

[58] Field of Search ..... 24/211 R, 211 P, 214, 24/110, 221 K; 292/62; 339/252 R

[56] References Cited

U.S. PATENT DOCUMENTS

| | | | |
|---|---|---|---|
| 1,012,222 | 12/1911 | Phinney | 24/214 |
| 1,056,452 | 3/1913 | Remhilt | 24/214 |
| 1,082,455 | 12/1913 | Tilton | 24/211 P |
| 1,169,693 | 1/1916 | Swedlund | 24/211 R |
| 1,603,159 | 10/1926 | Snyder | 24/221 K |
| 2,112,247 | 3/1938 | McLoughlin | 24/214 |
| 2,271,500 | 1/1942 | Rickenbach | 24/214 |
| 2,729,799 | 1/1956 | Pistey | 339/252 R |
| 3,085,222 | 4/1963 | Watts | 339/252 R |
| 3,125,396 | 3/1964 | Bertram | 24/211 R |
| 4,087,152 | 5/1978 | Kolm | 339/252 R |

FOREIGN PATENT DOCUMENTS

| | | | |
|---|---|---|---|
| 532894 | 11/1956 | Canada | 24/221 K |
| 258659 | 5/1949 | Switzerland | 24/221 K |

*Primary Examiner*—Victor N. Sakran
*Attorney, Agent, or Firm*—Ralph R. Roberts

[57] ABSTRACT

A safety clasp for necklaces, bracelets and the like is provided with a leaf spring member having its ends canted outwardly so as to enter and engage receiving apertures formed in an outer member. Retaining rings are provided at each end of the separable clasp with the outer member having an outer tubular sleeve with an open and a closed end and with apertures formed intermediate its length. An inner member is slidable and rotatable within the outer member and carries the leaf spring by a spine member with said spring secured at its midlength at the inner end of the spine. Receiving means for the leaf spring is provided in and along the spine and a bias such as a coil spring is secured at the closed end and internal of the outer member to urge the inner member outwardly. A quarter-turn of this inner member is made to bring the ends of the leaf spring from in way of the apertures formed in the outer member.

16 Claims, 17 Drawing Figures

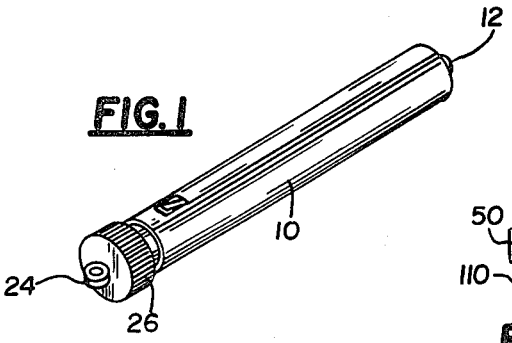
FIG. 1
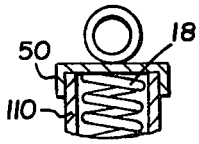
FIG. 2B
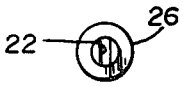
FIG. 6
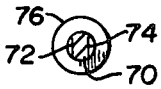
FIG. 9
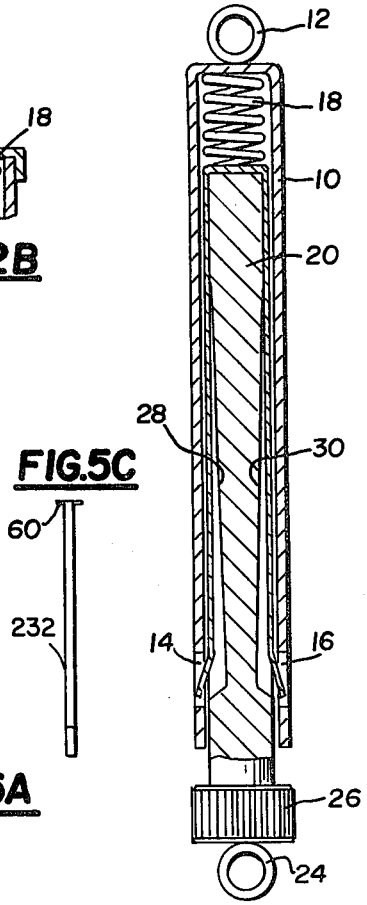
FIG. 2A
FIG. 5C
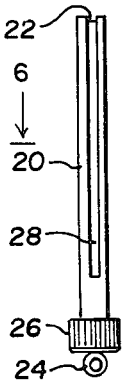
FIG. 3
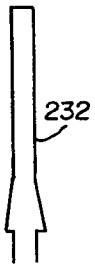
FIG. 4C
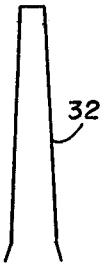
FIG. 4A
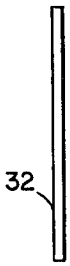
FIG. 5A
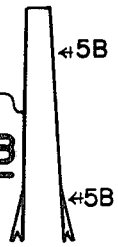
FIG. 4B
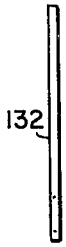
FIG. 5B
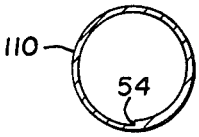
FIG. 8A
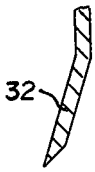
FIG. 7A
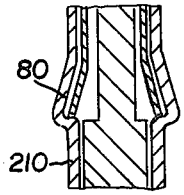
FIG. 8B
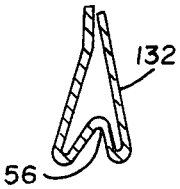
FIG. 7B

NECKLACE RETAINING CLASP

BACKGROUND OF THE INVENTION

1. Field of the Invention

With reference to the field of art as established in and by the U.S. Patent Office this invention is believed to be found in the general class entitled, "Separable Fasteners" (Class 24) and in the subclass therein entitled, "Pivoted lock mounted on head" (Subclass 211P) and the subclass entitled, "Rigid socket" (Subclass 214).

2. Description of the Prior Art

Safety catches and clasps for necklaces have been the subject of many inventions. Most of these pertain to clasps that are designed to secure a hook-like end in a guard or a pin retaining sheath and/or cover. Quarter-turn lock and release apparatus are also well known. In Applicant's device there is provided a wing-type spring carried by and in an inner member of a safety spring catch. The other and outer sleeve portion has apertures for receiving and retaining the ends of the wing-type spring. A coil spring carried by and secured in this outer sleeve portion urges the other companion portion outwardly with the wing-type spring ends engaging the apertures.

Quarter-turn and releasing fasteners are well known and the following show releasable fastening devices:

U.S. Pat. No. 1,012,222 to Phinney on Dec. 19, 1911;

U.S. Pat. No. 1,082,455 to Tilton on Dec. 23, 1913;

U.S. Pat. No. 1,603,159 to Snyder on Oct. 12, 1926, and

U.S. Pat. No. 2,271,500 to Rickenbach on Jan. 27, 1942.

U.S. Pat. No. 1,056,452 to Remhilt as issued on Mar. 18, 1913 shows a slotted receiver and a spring actuated pronged companion member that is released by a quarter-turn action. This reference is quite satisfactory as a post binder but this patent does not teach or suggest Applicant's securing together with a constant spring pressure to retain the portions together until a deliberate compressing motion is made to close the wing-type members and then a quarter-turn is made to release the spring-type safety catch.

SUMMARY OF THE INVENTION

This invention may be summarized, at least in part, with reference to its object. It is an object of this invention to provide, and it does provide, a necklace retaining clasp. The terminal members of this clasp are easily placed within each other to close said clasp and in this secured condition are retained by a spring carried in an outer sheath member. The inner member is easily removed when this said inner member is moved against this spring which causes a wing-type spring carried by this second member to be inwardly moved and with a quarter-turn is caused to be released for separation of the clasp.

In brief, this spring-type clasp for necklaces, bracelets and/or the like includes an outer member which is tubular in configuration and with this member having a closed end and an open end. The closed end also has secured thereto a connecting ring to which one end of the chain or string of the necklace is secured. This tubular member has opposed apertures provided near its open end. A coil spring is carried and secured within this member and at its closed end. A mating member is also generally tubular with a closed end to which there is also secured a connecting ring which may be secured to the other end of the chain or string. A collar may be secured to this second member to limit the inward movement of the second member within the first. A wing-type lock spring is secured within shaped recesses in this second member and the free ends are adapted to enter the apertures in the outer member and retain the clasp together. A pushing of the second member further within the outer member causes said wing-type spring to be withdrawn from the apertures in the outer member and with a quarter-turn allows the catch to be easily separated.

In addition to the above summary the following disclosure is detailed to insure adequacy and aid in understanding of the invention. This disclosure, however, is not intended to cover each new inventive concept no matter how it may later be disguised by variations in form or addition of further improvements. For this reason there has been chosen a specific embodiment of a necklance retaining clasp and showing a preferred means for construction of this clasp. This specific embodiment has been chosen for the purposes of illustration and description as shown in the accompanying drawing wherein:

BRIEF DESCRIPTION OF THE DRAWING

FIG. 1 represents an isometric view of an assembled necklace retaining clasp of this invention;

FIG. 2A represents a sectional side view in a greatly enlarged scale and diagrammatically showing the relationship of the several components of a clasp in a closed retaining condition for a necklace, bracelet and/or the like;

FIG. 2B represents a fragmentary side view substantially in the scale of FIG. 2 and showing the outer tubular member closed at its distal end with and by an attached cap member;

FIG. 3 represents a side view of an inner member without the presence of a tension lock, leaf-type spring;

FIG. 4A represents a front view of the tension lock, leaf-type spring before mounting and securing of said spring in an inner member;

FIG. 4B represents a front view of an alternate tension lock leaf-type spring with a U-shaped end and before mounting;

FIG. 4C represents a front view of yet another alternate construction of a tension lock, leaf-type spring;

FIG. 5A represents a side view of the spring of FIG. 4A, this view taken of the line 5A—5A thereof and looking in the direction of the arrows;

FIG. 5B represents the side view of the spring of FIG. 4B;

FIG. 5C represents the side view of the spring of FIG. 4C;

FIG. 6 represents an end view of the inner tubular member, this view taken on the line 6—6 of FIG. 3 and looking in the direction of the arrows;

FIG. 7A represents an enlarged, partly fragmentary, sectional view of an end of a spring as in FIG. 4A;

FIG. 7B represents a side view, partly diagrammatic, and showing a tension lock, leaf-type spring with a V-cut in each free end as in FIG. 4A;

FIG. 8A represents a sectional view of an alternate construction of an outer tubular member, the construction of this tubular member providing a guide shoulder;

FIG. 8B represents an enlarged, sectional side view showing a leaf spring retainer formed in the outer member with a cup shape in the outer wall of the outer tubular member, and FIG. 9 represents a fragmentary, partly diagrammatic sectional view of an inner member made from an extrusion and forming the spine of the inner member.

In the following description and in the claims various details are identified by specific names for convenience. These names are intended to be generic in their application. Corresponding reference characters refer to like members throughout the several figures of the drawing.

DESCRIPTION OF THE PREFERRED EMBODIMENT

Referring next to the drawing in which the spring-type safety catch is shown, both as components and in an assembled condition, it is to be noted that an outer tubular member 10 includes an open and a closed end. At the closed end there is secured, as by soldering or the like, a connecting ring 12. This ring is provided to enable the necklace chain or string to be secured to the clasp. Near the open end of the outer tubular member 10 are formed opposed apertures 14 and 16. Within this member 10 and at its closed end there is secured and provided a coil spring 18. This spring is secured at its lower end as by solder, cement or the like so that the spring is not dislodged during and by use. This does not preclude using a resilient plug member such as rubber to provide the desired bias.

The other and mating member includes a tubular portion 20 that is shown as having a notch 22 formed in its distal end. The other end is closed and another connecting ring 24 is secured to the outer end of this member. This mating member is a slide or slip fit within the tubular member 10. Preferably there is provided an outer collar member 26 attached to the member at the closed end thereof. This collar 26 provides a stop to limit the inward movement of the inner member within the outer member. This collar member may also be lightly knurled or decoratively roughened to assist in manipulation and turning.

The tubular portion 20 below the collar 26 is preferably made or drawn from thin walled tubing and into the sidewall portion is formed two retaining grooves 28 and 30. Each groove terminates at the notch 22. A shaped leaf spring 32 is of a channel shape with the side portions of extended length and with the free ends slightly outwardly canted. This spring 32 is made with the side portions extending outwardly. The ends of the spring may be square cut or notched. A square cut is shown in FIG. 4A and a notch alternate construction is shown in FIG. 4B. Another spring configuration is shown in FIG. 4C.

Alternate Outer Tubular Configuration of FIG. 2B

Referring now to the drawing and FIG. 2B, it is to be noted that the outer member may have a tubular member 110 which may be a tubular portion cut to length and at the closed end there may be provided a drawn or shaped cap 50 to which a ring 52 is secured. This cap may also provide the securing means for an end of spring 18. This cap 50 may also be used with a shouldered tube (FIG. 8A) having at least one stop shoulder 54 longitudinally provided. The shoulder 54 is adapted to provide a guide for an end of a spring 18 as it is brought to an aperture 14 or 16. If the tube is an extrusion there may be two stop shoulders 54 provided.

Leaf Spring of FIGS. 4A, B and C and 5A and B

The simplest formed spring is shown in FIG. 4A and has square cut and outwardly canted ends as in FIGS. 4A, 5A and 7A. This spring is usually of a tempered steel ribbon which is bent to the configuration shown and identified as 32. The leaf spring may also be bent to provide a notch 56 (FIGS. 4B. 5B and 7B) at the distal ends of the spring. This spring is identified as 132 (FIGS. 4B and 5C) and may also be used in the embodiment shown. In FIGS. 4C and 5C there is shown an alternate leaf spring configuration 232 in which the upper ends are retained in slots provided in a modified central portion of an inner member 120. As shown in FIG. 9 it is to be noted this this spring may be secured at its midportion by a retaining collar or sleeve 60 which is slid onto the tubular portion 120 and retained thereon by solder or cement.

Leaf Spring as in FIGS. 7A and 7B

The leaf spring as depicted may have a square cut end as in FIG. 7A or may have a V-shaped end as in FIG. 7B. No matter the configuration selected it is anticipated that the ends of the spring will enter and be retained by the apertures or cups formed in an outer member.

Tubing Configuration as in FIGS. 8A and 8B

The outer tubular member may be formed with internal shoulders that are engaged by spring 32 as it is turned to determine the desired alignment with the apertures 14 and 16. This is depicted in FIG. 8A in the drawing. It is also contemplated that apertures may not be used but cup shaped recesses 80 be formed in tubing 210 with shoulder stops that prevent uncoupling until pushing inward and a quarter turn made. Cups 80 are shown in FIG. 8B. This is not the preferred construction since an outer member 210 is usually made of thin tubing and with abuse an outwardly extending cup portion may be deformed to the extent that the securing of the clasp may be less than positive.

Alternate Construction of Inner Member as seen in FIG. 9

Referring next and finally to FIG. 9, there is depicted a center spine portion of an inner member which includes an extrusion identified as 70 and having flats 72 and 74. As depicted, this spine is a solid extrusion and the flats thereon accommodate the leaf spring as it is cammed inwardly during insertion. This extrusion may be hollow and may have shallow grooves longitudinally disposed in an extrusion such as seen in FIG. 6 rather than flats. The manufacturer of the clasp can and may select the desired configuration and size. An end member 76, much like that shown in FIG. 2B provides the end closure and retainer for the ring member. The spine is shown with flats but a spine having the desired clearance for a leaf spring may be provided with only a smaller diameter as long as the leaf spring is secured at its mid-point.

Use and Operation

The spring-type safety clasp is quite fool proof and easy to manipulate. The chain or string of the necklace and the like is secured at each end to connecting rings 12 and 24, usually by auxiliary links that may be opened and closed by the jeweler attaching this clasp to the necklace. The wearer of the necklace inserts the tubular portion 20 into the outer member 10 and continues insertion until resistance by coil spring 18 is encountered. The members are rotated one with the other until the outer ends of the leaf spring 32 enters and is retained by apertures 14 and 16. Spring 18 urges the inner member 20 outwardly to provide bias for retaining the clasp in a secured position. A disconnect of the clasp is easily achieved by the user with a simple inward displacement of member 20 in outer member 10 until collar 26 provides a stop. The user then makes a quarter-turn which moves the ends of spring 32 from alignment with apertures 14 and 16 and the clasp is then readily disengaged.

The outer tubular portion may be formed with an internal longitudinal shoulder guide. As depicted in FIG. 8A an outer tubular member 110 is formed with at least one longitudinal shoulder guide 54. This shoulder guide is aligned with an aperture so that the shaped spring 32 is easily guided into a receiving aperture. Preferably the spring 32 has a square cut at the free ends thereof so that these ends are disposed to enter and engage the apertures formed in the outer tubular member. Alternately, the shaped leaf spring may have its ends formed with notches or V-shapes 56 so that the projecting portion of said ends will enter and engage an aperture formed in the outer member. The V-shaped ends are shown in FIGS. 4B, 5B and 7B and are provided in an alternate leaf spring 132.

It is to be further noted that a cap portion 50 (FIG. 2B) may be used to close the end of the outer tube to provide a decorative and manipulative assist. The connecting rings are shown as generally circular but may be made in any desired configuration and need not be fixed but may be pivoted or swivel mounted. The ends of the leaf spring 32 or 132 are configured to enter and engage the apertures 14 and 16 and are maintained in this position by spring 18 which may be a compression coil spring or may be a resilient member. Gold or similar plating to prevent tarnish is provided to this clasp. Plating is suggested since the cost of precious metals is very high but this is not to preclude their use. The midportion of spring 32, 132 or 232 are shown as flattened to be retained in the notch 22 by a crimp action but solder or other adhesive means is contemplated. The use of a sleeve and the possible elimination of the notch 22 is not overlooked in this application since the production configuration of the components of the clasp will be selected to conform with the available materials and/or production levels. Dies, assembly tools, etc. are cost considerations to be evaluated and balanced in the production of the clasp.

It is to be noted that the above described clasp may have an outer tubular member 10 that is not completely closed at its retaining end but is sufficiently closed to provide retention means for the spring 18 and provide a retaining means for the connecting ring 12. In this regard the tubular member may be made of sheet metal with the formed apertures and shoulders then rolled into a tube and then with the closed end having an attached end cap with the ring attached thereto as in FIG. 2B. The tension lock spring 32 may be of generally channel shape with a short more-or-less straight portion or a curved midportion may be provided. The configuration is merely a matter of choice as long as the spring is secured to the inner member in a preestablished orientation. In a mounted condition the two extending ends are disposed or canted outwardly so as to extend and engage the apertures or cups formed in the outer member. The apertures 14 and 16 are shown as rectangular but may be of any configuration as long as the ends of spring 32 enter and engage said apertures during retentive positioning. The formed apertures or cups are disengaged by the ends of spring 32 when the clasp is closed against spring 18 and a quarter turn is achieved when and as the ends of the spring are within the outer tubular member. It is to be noted that the outward flare or disposition of the distal or free ends of spring 32, 132 or 232 are guided inwardly to a position within the wall of the outer tube when the member 20 is pushed inwardly to the collar stop. This inward motion is readily ascertained in FIG. 2A to cause the ends of said springs to be cammed inwardly of the apertures.

It is, of course, realized that the clasp may be made substantially of plastic and use only metal for the spring 32. The inner member may have grooves 28 and 30 formed as flats or grooves in an extrusion as in FIG. 9. The spring 32 may be held in place by an attached collar, said collar held in place by solder or cement. The grooves or flats are used to provide a guideway for the spring. The spring 32, 132 or 232 may be made from flat stock or may have thicker ends. Whatever the configuration, the springs 32, 132 or 232 lay within the outer member when inserted and the outward flare or cant of said spring ends is guided with and by the tubular confines. When tubular portion 20 is inserted to engage spring 18 the resistance is felt and the turning to bring the ends of the spring in way of the apertures 14 and 16 or cups 80 for securing the clasp is easily achieved. The placement of the opposed apertures 14 and 16 in the outer member 10 is merely a matter of choice as any intermediate position may be selected. Preferably the apertures are equidistant from an end but this is only a matter of convenience of use and unequal spacing is also contemplated. It is only important that about a quarter turn of the members to each other be achievable when moved to substantially an inward condition whereat the spring 32 is cammed inwardly from the apertures 14 and 16 to allow said rotation.

Terms such as "left", "right", "up", "down", "bottom", "top", "front", "back", "in", "out" and the like are applicable to the embodiments shown and described in conjunction with the drawing. These terms are merely for the purposes of description and do not necessarily apply to the position in which the necklace retaining clasp may be constructed or used.

While a particular embodiment of the clasp and alternate embodiments have been shown and described it is to be understood the invention is not limited thereto and protection is sought to the broadest extent the prior art allows.

What is claimed is:

1. A readily separable and joinable retaining clasp for a necklace, bracelet and the like, this clasp preferably of cylindrical configuration and including:

(a) an outer member which is generally tubular in configuration and having opposed apertures providing retaining means formed in the sidewalls thereof with said formed apertures intermediate the ends of said member, the tubular portion having a first open end and a second end sufficiently closed to provide a retaining means at and in said second end;

(b) a bias means carried within the outer member and secured at the second end, this bias means adapted to slide within said tubular outer member to provide a thrust force toward the open end of the outer member when said bias means is moved toward the second end;

(c) at least one chain or string attaching means provided with and by said outer member;

(d) an inner member freely slidable and rotatable within the tubular configuration of the outer member, said inner member having a first and second end, said first end having at least one chain or string attaching means provided therewith and with said second end having a leaf-type spring retaining means provided and formed thereon;

(e) a U-shaped leaf-type spring having its extending leg portions slightly canted outwardly so that the legs extend outwardly at least slightly more than the inner diameter of the tubular portion of the outer member, the extending leg portions less in length than the tubular portion of the outer member when in an assembled condition, said extending leg portions having each leg formed with a further outwardly extending portion sized and shaped so as to enter and engage one of the opposed apertures when brought in way thereof;

(f) means for securing said U-shaped leaf-type spring at its midportion to said inner member at or near its second end and in said leaf-type spring retaining means so that the leg portions of said U-shaped leaf-type spring are movable outwardly to engage the tubular portion of the outer member and with the unsecured and further outwardly extending portions of said U-shaped leaf-type spring adapted to enter and be retained in said opposed aperture retaining means, and (g) means for providing in the sides of the inner member recesses into which the leg portions of the U-shaped leaf-type spring may enter during insertion of the inner member into said outer member for retention, whereby the insertion of the inner member into the outer member causes the leg portions of the U-shaped leaf-type spring to be canted inwardly to slide within the inner diameter of the tubular portion and by manipulation the further outwardly extending leg portions of the U-shaped leaf-type spring are caused to enter the opposed formed apertures and the bias means engages and urges the inner member outwardly and disengagement is easily achieved by moving the inner member against said bias until the further outwardly extending portions of the U-shaped leaf-type spring are cammed from the formed apertures and a rotative motion moves the further outwardly extending portions of the U-shaped leaf-type spring from in way of the formed apertures and disengagement is achieved.

2. A clasp as in claim 1 in which the outer member has a closed end and in which the chain or string attaching means is a ring-type member secured at its closed end.

3. A clasp as in claim 1 in which the tubular portion of the outer member is formed with at least one longitudinal guide adapted to engage an extending leg portion of the leg of the U-shaped leaf-type spring and guide said extending leg portion of said U-shaped, leaf-type spring toward and to an aperture formed in the outer member.

4. A clasp as in claim 1 in which the outer portion has at its second end a cap portion and having said cap portion secured to the tubular portion.

5. A clasp as in claim 1 in which the bias means carried within the outer member is a coil spring of metal.

6. A clasp as in claim 1 in which the means provided in the sides of the inner member are flats in the sides of an extrusion.

7. A clasp as in claim 1 in which the inner member is of a tubular construction and in opposed sides there are formed opposed recesses into which the leg portions of the U-shaped leaf-type spring may enter during insertion and manipulation.

8. A clasp as in claim 1 in which the U-shaped leaf-type-spring has substantially equal extending legs with the further outwardly extending portions being ends formed so as to enter the apertures in the outer member when the bias means is sufficiently actuated to urge the inner member outwardly.

9. A clasp as in claim 8 in which the ends of the leaf U-shaped, leaf-type spring are square cut.

10. A clasp as in claim 8 in which the ends of the leaf U-shaped, leaf-type spring are made with a retaining notch.

11. A clasp as in claim 8 in which the U-shaped, leaf-type spring has each leg formed with a midportion having said further outwardly extending portions so positioned and formed as to enter one of the opposed apertures in said outer member.

12. A clasp as in claim 11 in which the inner member has a tubular midportion into which recesses are formed for retention and movement of those upper leg portions extending beyond the midportion and to the ends of said U-shaped, leaf-type spring.

13. A clasp as in claim 1 in which the inner member is made as an extrusion and with flats longitudinally formed in said extrusion and into which the leg portions of the U-shaped leaf-type spring may move.

14. A clasp as in claim 1 in which the inner member has its second end formed with a notch into which the midportion of the U-shaped leaf-type spring is positioned and secured to provide the retaining means.

15. A clasp as in claim 1 in which most of the components are made of plastic.

16. A clasp as in claim 1 in which the inner member is made as an extrusion with grooves longitudinally formed into which the leg portions of the U-shaped, leaf-type spring may move.

17. A readily separable and joinable retaining clasp for a necklace, bracelet and the like, this clasp preferably of cylindrical configuration and including:

(a) an outer member which is generally tubular in configuration and having a pair of opposed and localized cups providing retaining means formed in the sidewalls thereof with said pair of formed cups intermediate the ends of said member, the tubular portion having a first open end and a second end sufficiently closed to provide a retaining means at and in said second end;

(b) a bias means carried within the outer member and secured at the second end, this bias means adapted to slide within said tubular outer member to provide a thrust force toward the open end of the outer member when said bias means is moved toward the second end;

(c) at least one chain or string attaching means provided with and by said outer member;

(d) an inner member freely slidable and rotatable within the tubular configuration of the outer member, said inner member having a first and second end, said first end having at least one chain or string attaching means provided therewith and with said second end having a leaf-type spring retaining means provided and formed thereon;

(e) a U-shaped leaf-type spring having its extending leg portions slightly canted outwardly so that the legs extend outwardly at least slightly more than the inner diameter of the tubular portion of the outer member, the extending leg portions less in length than the tubular portion of the outer member when in an assembled condition, said extending leg portions having each leg formed with a further outwardly extending portion sized and shaped so as to enter and engage one of the opposed localized cups when brought in way thereof;

(f) means for securing said U-shaped leaf-type spring at its midportion to said inner member at or near its second end and in said leaf-type spring retaining means so that the leg portions of said U-shaped leaf-type spring are movable outwardly to engage the tubular portion of the outer member and with the unsecured and further outwardly extending portions of said U-shaped leaf-type spring adapted to enter and be retained in one of said opposed cups, and (g) means for providing in the sides of the inner member recesses into which the leg portions of the U-shaped leaf-type spring may enter during insertion of the inner member into said outer member for retention, whereby the insertion of the inner member into the outer member causes the leg portions of the U-shaped leaf-type spring to be canted inwardly to slide within the inner diameter of the tubular portion and by manipulation the further outwardly extending leg portions of the U-shaped leaf-type spring are caused to enter the opposed pair of formed cups and the bias means engages and urges the inner member outwardly and disengagement is easily achieved by moving the inner member against said bias until the further outwardly extending portions of the U-shaped leaf-type spring are cammed from the formed cups and a rotative motion moves the further outwardly extending portions of the U-shaped leaf-type spring from in way of the formed cups and disengagement is achieved.

* * * * *

UNITED STATES PATENT AND TRADEMARK OFFICE

CERTIFICATE OF CORRECTION

PATENT NO. : 4,358,876

DATED : November 16, 1982

INVENTOR(S) : Aldo Colognori

It is certified that error appears in the above-identified patent and that said Letters Patent is hereby corrected as shown below:

On the title page item [73] should read:

Assignees: --Aldo Colognori; Sebastian Zuppichini; Thomas McBride, all of New Jersey--.

Signed and Sealed this

*Twenty-eighth* Day of *June 1983*

[SEAL]

*Attest:*

GERALD J. MOSSINGHOFF

*Attesting Officer*

*Commissioner of Patents and Trademarks*